US005324098A

United States Patent [19]

Massa et al.

[11] Patent Number: 5,324,098

[45] Date of Patent: Jun. 28, 1994

[54] CUTTING TOOL HAVING HARD TIP WITH LOBES

[75] Inventors: Ted R. Massa, Latrobe; John J. Prizzi, Greensburg, both of Pa.

[73] Assignee: Kennametal Inc., Latrobe, Pa.

[21] Appl. No.: 992,950

[22] Filed: Dec. 17, 1992

[51] Int. Cl.[5] ..... F21C 35/18

[52] U.S. Cl. ..... 299/86; 175/427

[58] Field of Search ..... 299/79, 86, 91; 175/427

[56] References Cited

U.S. PATENT DOCUMENTS

| | | | |
|---|---|---|---|
| 3,356,418 | 12/1967 | Healey et al. | 299/91 |
| 3,830,546 | 8/1974 | Kniff | 299/86 |
| 4,497,520 | 2/1985 | Ojanen | 299/86 |
| 4,725,099 | 2/1988 | Penkunas et al. | 299/86 |
| 4,729,603 | 2/1988 | Elfgen | 299/93 |
| 4,865,392 | 9/1989 | Penkunas et al. | 299/86 |
| 4,911,503 | 3/1990 | Stiffler et al. | 299/79 |
| 4,911,504 | 3/1990 | Stiffler et al. | 299/91 |
| 4,938,538 | 7/1990 | Larsson et al. | 299/86 |
| 4,981,328 | 1/1991 | Stiffler et al. | 299/79 |
| 5,054,217 | 10/1991 | Nilsson et al. | 299/86 X |
| 5,131,725 | 7/1990 | Rowlett et al. | 299/79 |
| 5,219,209 | 6/1993 | Prizzi et al. | 175/427 X |

FOREIGN PATENT DOCUMENTS

| | | | |
|---|---|---|---|
| 0052978 | 6/1982 | European Pat. Off. . | |
| 0122893 | 10/1984 | European Pat. Off. . | |
| 0160757 | 11/1985 | European Pat. Off. . | |
| 2846744 | 4/1980 | Fed. Rep. of Germany . | |
| 3510072 | 9/1986 | Fed. Rep. of Germany . | |
| 519538 | 7/1976 | U.S.S.R. | 299/79 |
| 751991 | 7/1980 | U.S.S.R. . | |
| 825924 | 4/1981 | U.S.S.R. . | |
| 899916 | 1/1982 | U.S.S.R. . | |

OTHER PUBLICATIONS

Carbide tip depicted in Multi-Metals Dwg. C-1445-7 (Sep. 5, 1973).

Carbide tip depicted in American Mine Tool Dwg. T-104-76 (Sep. 14, 1982).

Carbide tip depicted in Kennametal Dwg 921-01135 (Aug. 18, 1983).

Carbide tip depicted in American Mine Tool Dwg T-104-13 (Nov. 30, 1982).

Carbide tip depicted in American Mine Tool Dwg. T-104-14 (Aug. 31, 1984).

Carbide tip depicted in Kennametal Dwg. DEV--C-1736 (Jan. 31, 1980).

Carbide tip depicted in Kennametal Dwg. 921-01171 (Dec. 4, 1986).

Carbide tip depicted in Kennametal Dwg. 921-01173 (Mar. 2, 1987).

*Primary Examiner*—David J. Bagnell

*Attorney, Agent, or Firm*—John J. Prizzi; Stephen T. Belsheim

[57] ABSTRACT

A cutting tool for use in excavating an earth formation comprising an elongate tool body having a hard tip being affixed to the forward end thereof. The hard tip has a plurality of integral, coaxial sections including an integral ribbed section which presents a plurality of longitudinal ribs about the circumference thereof. The tip further includes an integral lobed base section which presents a plurality of radially extending lobes. An integral transition region provides a transition between the ribbed section and the base section.

20 Claims, 5 Drawing Sheets

CUTTING TOOL HAVING HARD TIP WITH LOBES

BACKGROUND OF THE INVENTION

The invention pertains to cutting tools used in excavating earth formations wherein a block on a driven body, such as a drum or a wheel or a blade, contains the cutting tool having a hard tip at the forward end thereof. More specifically, the invention pertains to the shape of the hard tip.

Cutting tools are a consumable component of the overall apparatus used to break an earth formation (e.g. rock, asphalt, coal, concrete, potash, trona) into a plurality of pieces which comprise abrasive cuttings. For example, a road planing machine uses cutting tools which mount in blocks on a driven drum. An engine in the road planing apparatus drives the drum. The rotation of the drum causes the cutting tools to impinge upon a road surface, such as asphalt. The result is to break the road surface into small pieces thereby creating abrasive cuttings. The abrasive cuttings are removed thereby preparing the roadway for resurfacing.

The typical cutting tool comprises an elongate tool body (typically made of steel) with an axially forward end and an axially rearward end. The cutting tool contains a means for retaining the tool in the bore of the block. Such a retention means may retain the cutting tool in such a fashion that it is rotatable with respect to the block or it is non-rotatable with respect to the block. The block mounts on a rotatable drum driven by the overall apparatus. A hard cutting tip, which may be made from a cemented tungsten carbide (WC-Co alloy) having a cobalt content ranging from about 5 to about 13 weight percent, affixes to the forward end of the cutting tool. Typically, one brazes the hard cutting tip to the tool body.

The hard cutting tip is the component of the cutting tool that first impinges upon the earth formation or substrate. Thus, there has been an interest in the shape of the hard cutting tip, and the influence the shape of the hard cutting tip has on the performance of the cutting tool.

There have been three basic concerns associated with a hard cutting tip. One concern has been to provide a hard cutting tip that easily penetrates and cuts the earth formation. Another concern has been to provide a hard cutting tip that has satisfactory strength so as to be able to endure throughout a cutting application without failure through catastrophic means such as fracture. Another concern has been to provide a hard cutting tip that helps protect the steel tool body, as well as the joint between the hard cutting tip and the steel tool body, from erosion by the abrasive cuttings, i.e., so-called "steel wash".

The hard cutting tip typically has been made from a powder via powder metallurgical techniques. In the manufacture of a part via powder metallurgical techniques, it is important that the powder move easily and uniformly during compaction so that the pressed, pre-sintered part has a uniform powder density. It is typical that a pre-sintered compact with a more uniform powder density will have less of a tendency to form regions having density variations or voids which can reduce the overall strength of the tip. In the past, hard cutting tips for cutting tools, wherein the hard cutting tip has been the product of powder metallurgical techniques, have at times experienced the presence of some degree of cracks or voids. As mentioned above, these cracks or voids have been typically due to a non-uniform powder density in certain volumes of the tip geometry. In some circumstances, the presence of surfaces that restrict the flow of powder contribute to such a non-uniform powder density in the pressed, pre-sintered part. Thus, it would be highly desirable to provide an improved cutting tool with a hard cutting tip that presents surfaces that do not restrict, or at least reduce the restriction to, the movement of powder to all volumes of the tip during the pressing thereof.

It has been the case that surfaces of the part which are somewhat perpendicular to the longitudinal axis of the part can create obstacles to powder flow, and hence, lead to a non-uniform powder density in the pressed pre-sintered tip. It would thus be highly desirable to provide an improved cutting tool with a hard cutting tip that presents a forward portion with a geometry that reduces the number of, or even eliminates all, surfaces that are generally perpendicular to the longitudinal axis of the hard cutting tip.

In some instances, the density of the powder in the larger dimension portions of the hard cutting tip have been greater than average. This is due to the restriction of powder moving from the larger dimension portions of the hard cutting tip during pressing. Thus, it would be highly desirable to provide an improved cutting tool wherein the powder density in the pressed, pre-sintered compact for the hard cutting tip has a generally uniform density, or at least a more uniform density than has been the case with earlier tip geometries.

The following patents and documents show cutting tools with hard cutting tips presenting specific geometric shapes. For example, some patents or documents show a hard cutting tip with a cylindrical section axially rearwardly of the conical tip section. Some patents or documents show a middle section of the hard cutting tip having a geometry with a contour.

U.S. Pat. Nos. 4,725,099 and 4,865,392 to Penkunas et al. each shows a cutting tool having an insert. The insert has a conical tip section, an integral axially rearward cylindrical section, an axially rearward integral frusto-conical section, an axially rearward integral fillet section and an axially rearward integral base section.

U.S. Pat. No. 4,938,538 to Larsson et al. and European Patent No. 0 122 893 to Larsson et al. each show a cutting tool with an insert. The insert has a conical tip section, an integral cylindrical section axially rearward of the tip portion, an integral arcuate section axially rearward of the cylindrical portion, an integral flange section axially rearward of the arcuate portion and an integral section by which the cutting insert mounts in a socket in the steel tool body.

Kennametal Drawing No. DEV-C-1736 depicts a cemented carbide tip for use in conjunction with a rotatable cutting tool. The tip presents a conical tip section and an integral frusto-conical intermediate section with a scallop or recess contained therein.

U.S. Pat. No. 4,729,603 to Elfgen shows a hard insert that presents a plurality of grooves filled in with a material that is softer than the remainder of the hard insert.

U.S. Pat. No. 5,131,725 to Rowlett et al., assigned to the assignee (Kennametal Inc. of Latrobe, Pa.) of the present patent application, shows a cemented carbide tip for a rotatable cutting tool. The geometry of the cemented carbide tip presents a trio of radially extending fins that transcend a cylindrical section to a concave section to a frusto-conical section.

U.S. Pat. No. 3,356,418 to Healey et al. shows a hard insert with a plurality of longitudinal splines.

Soviet Authors Certificate No. 751,991 for a MINING MACHINE PICK WITH HARD METAL TIP shows a hard metal tip. The tip presents a plurality of conical surfaces (7) that intersect to form a plurality of ribs. Each rib appears to travel from near the axially forward portion of the tip to the axially rearward portion of the hard metal tip.

Soviet Authors Certificate No. 825,924 shows a hard insert with ribs that engage slots in the steel body of the tool.

German Publication No 3510072 shows a hard insert having longitudinal grooves used to facilitate solder distribution in the attachment of the hard insert to the tool body.

SUMMARY OF THE INVENTION

It is an object of the invention to provide an improved cutting tool with a hard cutting tip.

It is another object of the invention to provide an improved cutting tool with a hard cutting tip that presents a geometry that promotes a uniform powder density in the pressed, pre-sintered compact.

It is another object of the invention to provide an improved cutting tool with a hard cutting tip wherein the tool easily penetrates and cuts an earth formation.

It is another object of the invention to provide an improved cutting tool with a hard cutting tip wherein the tool endures throughout a cutting application.

It is another object of the invention to provide an improved cutting tool with a hard cutting tip wherein the hard cutting tip has improved resistance to fracture or failure due to voids or cracks or the like.

In one form thereof, the invention is a hard tip for attachment at a joint to a tool body of an excavation tool for impinging an earth formation. The hard tip comprises an integral lobed base section for protecting the tool body from wear caused by the tip impinging the earth formation. The lobed base section presents a plurality of radially extending lobes each having a peripheral edge axially forward of the joint.

In still another form, the invention is a cutting tool for excavating an earth formation whereby such excavation creates abrasive cuttings. The cutting tool comprises an elongate tool body having opposite forward and rearward ends and a hard tip is affixed on the forward end of the tool body. The hard tip comprises an integral forward region and an integral ribbed section presenting a plurality of longitudinal ribs about the circumference thereof. The ribbed section is axially rearwardly of the forward region. Each one of said ribs presents a leading edge that moves radially outwardly as the rib moves axially rearwardly so that during excavation the rib diverts abrasive cuttings in a radially outward direction. The hard tip further comprises an integral lobed base section which presents a plurality of radially extending lobes. An integral transition region is contiguous with the ribbed section and the base section so as to provide a transition from the ribbed section to the base section. An integral seating section is contiguous with and extends axially rearwardly of the base section.

These and other aspects of the present invention will become more apparent upon review of the drawings which are briefly described below in conjunction with the detailed description of the specific embodiments of the invention.

A detailed description of the specific embodiments shown in these drawings now follows.

DETAILED DESCRIPTION OF SPECIFIC EMBODIMENTS

Figure 1:
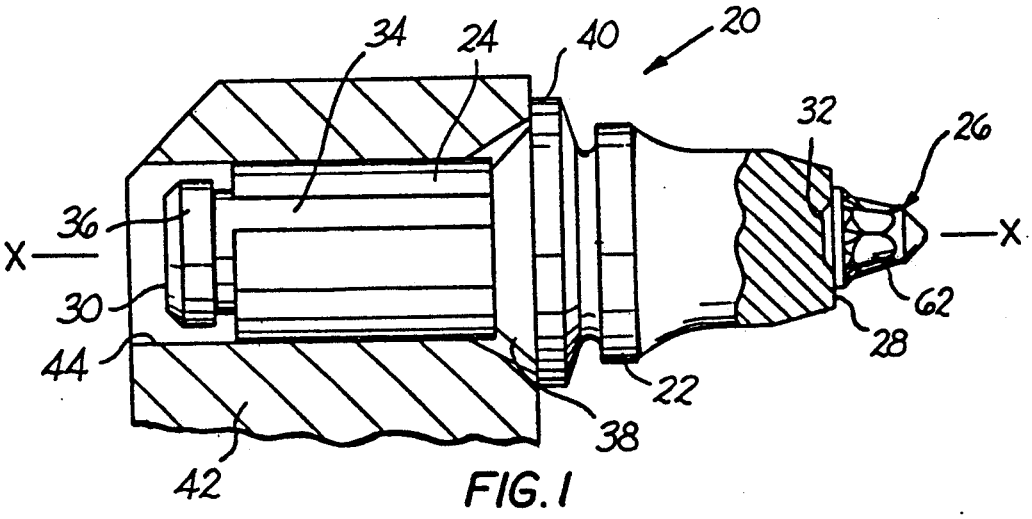
FIG. 1 is a side view of a complete specific embodiment of the cutting tool of the invention wherein a portion of the steel body has been cut-away to expose the juncture between the hard tip and the steel body.

FIG. 1 illustrates a specific embodiment of a cutting tool generally designated as 20. The specific embodiment of cutting tool 20 is free to rotate about its central longitudinal axis x—x during use. Even though the specific embodiment illustrates a rotatable cutting tool, applicant does not intend to limit the scope of the invention to only rotatable cutting tools. Applicant presently considers the scope of the invention to encompass any tool that is used to excavate earth formations.

Cutting tool 20 comprises three basic components; namely, an elongate tool body 22, a retainer sleeve 24 such as described in U.S. Pat. No. 4,201,421 to Den Besten et al., and a hard cutting tip 26.

The material for the hard cutting tip is typically a cemented tungsten carbide which is a composite of tungsten carbide and cobalt. The cemented carbide tip may be composed of any one of the standard tungsten carbide-cobalt compositions conventionally used for excavation applications.

The specific grade of cemented carbide depends upon the particular application to which one puts the cutting tool. The cobalt content ranges from about 5 to about 13 weight percent with the balance being tungsten carbide, except for impurities. For cutting tools used in road planing, it may be desirable to use a standard tungsten carbide grade containing between about 5.4 to about 6.0 weight percent cobalt (balance essentially WC) and having a Rockwell A hardness between about 88.2 and about 88.8.

Even though the specific embodiment of the hard cutting tip comprises cemented carbide, applicant does not consider the invention to be limited to a cemented carbide material for the tip. Applicant considers the scope of the invention to encompass hard tips made from any hard material that is useful for the excavation of earth formations.

The tool body 22, which is typically made of steel, has an axially forward end 28 and an axially rearward end 30. The forward end 28 preferably contains a socket 32 therein, and it is at this location that the hard tip 26 affixes to the tool body 22. However, applicant considers the scope of the invention to be broader than a tool body having a socket. For example, applicant presently considers the scope of the invention to include a hard tip with a recess in the rear surface thereof that corresponds in shape to a protrusion at the axially forward end of the tool body. U.S. Pat. No. 4,940,288 to Stiffler et al. (assigned to the assignee of this patent application) shows a hard tip and tool body with such a structure at the juncture of the hard tip and tool body.

It is preferred that a high temperature braze material be used in joining the hard tip to the steel body so that braze joint strength is maintained over a wide temperature range. The preferred braze material is a HIGH TEMP 080 manufactured and sold by Handy & Harman, Inc., 859 Third Avenue, New York, N.Y. 10022. The nominal composition (weight percent) and the physical properties of the Handy & Harman HIGH TEMP 080 braze alloy (according to the pertinent product literature from Handy & Harman, U.S. Pat. No. 4,631,171 covers the HIGH TEMP 080 braze alloy) are set forth below:

| | | |
|---|---|---|
| NOMINAL COMPOSITION | | |
| Copper | 54.85% | ±1.0 |
| Zinc | 25.0 | ±2.0 |
| Nickel | 8.0 | ±0.5 |
| Manganese | 12.0 | ±0.5 |
| Silicon | 0.15 | ±0.5 |
| Other Elements | 0.15 | |
| PHYSICAL PROPERTIES: | | |
| Color | Light Yellow | |
| Solidus | 1575° F. (855° C.) | |
| Liquidus (Flow Point) | 1675° F. (915° C.) | |
| Specific Gravity | 8.03 | |
| Density (lbs/cu. in.) | .290 | |
| Electrical Conductivity (% I.A.C.S.) | 6.0 | |
| Electrical Resistivity (Microhm-cm.) | 28.6 | |
| Recommend Brazing Temperature Range | 1675–1875° F. (915–1025° C.) | |

Another braze alloy which applicant considers to be acceptable is the HANDY HI-TEMP 548 braze alloy. HANDY HI-TEMP 548 alloy is composed of 55±1.0 w/o (weight percent) Cu, 6±0.5 w/o Ni, 4±0.5 w/o Mn, 0.15±0.05 w/o Si, with the balance zinc and 0.50 w/o maximum total impurities. Further, information on HANDY HI-TEMP 548 can be found in Handy & Harman Technical Data Sheet No. D-74 available from Handy & Harman, Inc. of New York, N.Y.

The tool body 22 has a reduced diameter section 34 near the rearward end 30 thereof. The enlarged diameter portions 36, 38, which define the ends of the reduced diameter portion 34, maintain the retainer sleeve 24 captive on the tool body 22. Because the reduced diameter portion 34 is of a dimension smaller than the inside dimension of the retainer sleeve 24, the retainer sleeve 24 is free to rotate relative to the tool body 22. The tool body 22 further includes a radially projecting flange 40. The flange 40 is preferably adjacent to the forward surface of the block 42 when the cutting tool 20 is in the bore 44 of the block 42.

The tool body 22 mounts in the bore 44 of a block 42 which affixes to a driven member (not illustrated) such as, for example, a drum of a road planing machine. Once the rotatable cutting tool 20 is within the volume of bore 44, the retainer sleeve 24 is resiliently compressed radially inwardly and thereby frictionally engages the wall of the bore 44. The tool 20 is thereby releasably retained in the block 42 in such a fashion so that it is free to rotate within the bore 44 relative to the block 42.

Figure 2:
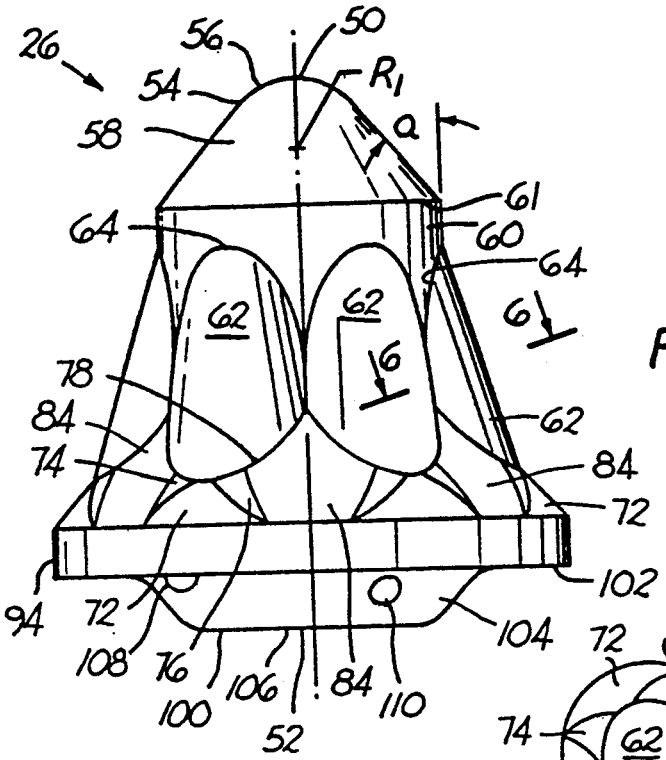
FIG. 2 is a side view of the hard tip from the cutting tool shown in FIG. 1 hereof.

Referring to FIG. 2, the hard tip 26 presents a plurality of distinct, but structurally integral, sections. Hard tip 26 has a top end 50 which is oppositely disposed from the bottom end 52. The following description describes each part of the hard tip 26 beginning at the top end 50 thereof and progressing to the bottom end 52 thereof. It should be understood that the description hereinafter will refer to various "sections", "portions" and a "region" of the hard tip. However, even though these parts are distinct for the purpose of this description, the hard tip is a monolithic part in which all of the "sections", "portions" and the "region" are integral parts of the entire tip.

An integral forward section 54 is at the top end 50 of the hard tip 26. It is preferable that the forward section 54 terminates in a generally spherically shaped portion 56. Spherical portion 56 has a radius of $R_1$ which in this specific embodiment is equal to about 0.125 inches. It is also preferable that a frusto-conically shaped portion 58 depends axially rearwardly from the spherical portion 56. The frusto-conical portion 58 preferably has a half angle of taper "a" equal to about 40° so that the total angle of taper of the frusto-conical portion 58 is about 80°. The spherical portion 56 and the frusto-conical portion 58 are structurally integral and coaxial along their central longitudinal axes. The spherical portion 56 and the frusto-conical portion 58 together comprise the forward section 54.

The hard tip 26 further includes an intermediate section 60 which is preferably of a generally cylindrical shape. The diameter "t" of the intermediate section 60 (see FIG. 8) is generally constant, and is preferably equal to the maximum diameter of the forward section 54. The forward section 54 and the intermediate section 60 join along a generally circular boundary 61.

The hard tip 26 further includes a plurality of longitudinal ribs 62 that extend axially rearwardly of the intermediate section 60. The intermediate section 60 and ribs 62 join along a boundary 64 that presents a configuration of a plurality of sequential arcuate portions. Although this specific embodiment presents a boundary having sequential arcuate portions, it should be appreciated that applicant presently contemplates that the boundary can present sequential portions that have a non-arcuate configuration or a boundary of some other configuration.

Ribs 62 also extend radially outwardly with respect to the central longitudinal axis of the hard tip 26. The distance of such radially outwardly extension of each rib 62 becomes greater as the rib 62 moves axially rearwardly which is shown, for example, in FIG. 2.

Figure 3:
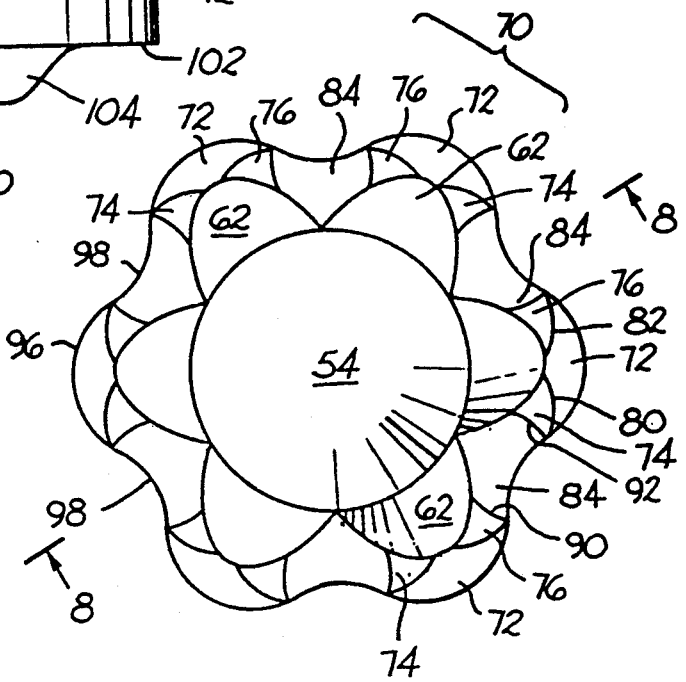
FIG. 3 is a top view of the hard tip of FIG. 2 hereof.

In the specific embodiment as shown in FIGS. 2 and 3, the hard tip 26 presents six ribs 62 spaced about 60° apart about the circumference of the intermediate section 60. As can be seen in FIG. 2, each rib 62 is at least partially contiguous with its corresponding sequential ribs 62. Even though in the specific embodiment the ribs 62 are partially contiguous, it should be understood that the invention does not require partial contiguity. The scope of the invention is broad enough to encompass a hard tip wherein the ribs are not contiguous. The present scope of the invention is also broad enough to cover a hard tip with fewer or greater than six ribs. These ribs 62 together comprise a ribbed section of the cemented carbide tip 26.

Figure 6:
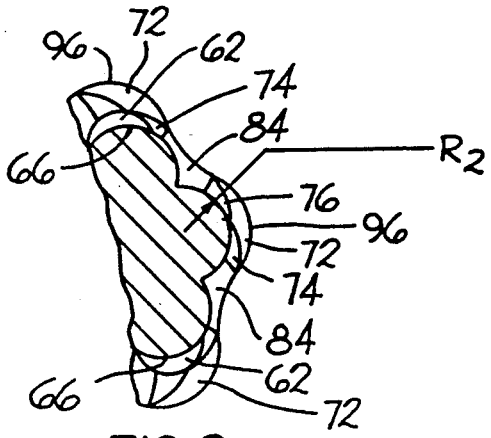
FIG. 6 is partial cross-sectional view of the hard tip of FIG. 2 taken along section line 6—6.

Because each rib 62 is essentially the same, the following description for one rib 62 will suffice for a description of the remaining ribs 62. Rib 62 has a top end and an opposite bottom end. Rib 62 presents a smooth arcuate surface 66, which FIG. 6 illustrates with particular specificity. As illustrated in FIG. 6, the radius of the arcuate surface 66 of the rib 62 is $R_2$ which in this specific embodiment is equal to about 0.103 inches.

Figure 5:
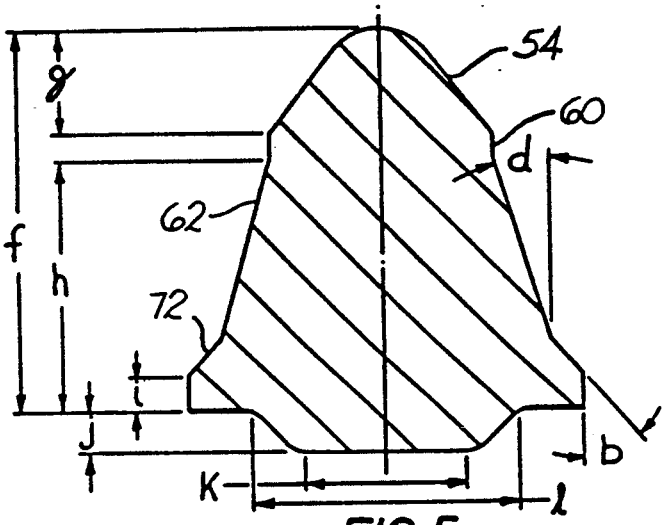
FIG. 5 is a cross-sectional view of the hard tip of FIG. 4 taken along section line 5—5.

Referring back to FIG. 2, rib 62 terminates adjacent the top end thereof wherein such termination defines, in part, the boundary 64 between the ribbed section and the intermediate section 60. As previously mentioned, this boundary 64 takes on the shape of sequential arcuate portions. Rib 62 terminates adjacent the bottom end thereof wherein such termination presents a generally arcuate shape. Referring to FIG. 5, each rib 62 is disposed from the central longitudinal axis of the hard tip 26 at an angle "d" which in this specific embodiment is equal to about 18°.

The hard tip 26 further comprises a transition zone, which is shown in FIG. 3 by brackets as 70, which corresponds to each rib 62. In the specific embodiment, there are six transition zones 70 equi- spaced about the circumference of the hard tip 26. Each transition zone 70 is contiguous with and extends axially rearward of its corresponding rib 62. Each transition zone 70 comprises a plurality of distinct, but structurally integral, sections. These sections comprise a central convex frusto-conical section 72 and a pair of lateral convex cylindrical sections 74 and 76.

Referring to FIGS. 2 and 3, the transition zone 70 and its corresponding rib 62 join along a portion of an arcuate boundary 78. The corresponding length of this arcuate boundary 78 separates each rib 62 from the axially forward terminations of its corresponding lateral cylindrical sections 74 and 76, and the central portion of the axially forward termination of its corresponding central convex frusto-conical section 72. This arcuate boundary 78 also separates the rib 62 from its corresponding sequential pair of mediate concave frusto-conical sections 84 which applicant describes hereinafter. The lateral convex cylindrical portions 74 and 76 join along their axially rearward terminations with the lateral portions of the axially forward termination of the central convex frusto-conical section 72 so as to define boundaries 80 and 82, respectively.

Referring to FIG. 5, in this specific embodiment the angle "b" at which the central convex frusto- conical section 72 is disposed from the central longitudinal axis of the hard tip 26 is preferably about 45°.

Referring back to FIGS. 2, 3 and 6, lateral cylindrical section 74 further presents a lateral termination that is contiguous with its corresponding adjacent mediate concave frusto-conical section 84. Lateral cylindrical section 76 likewise presents a lateral termination that is contiguous with its corresponding adjacent mediate concave frusto-conical section 84.

Figure 7:
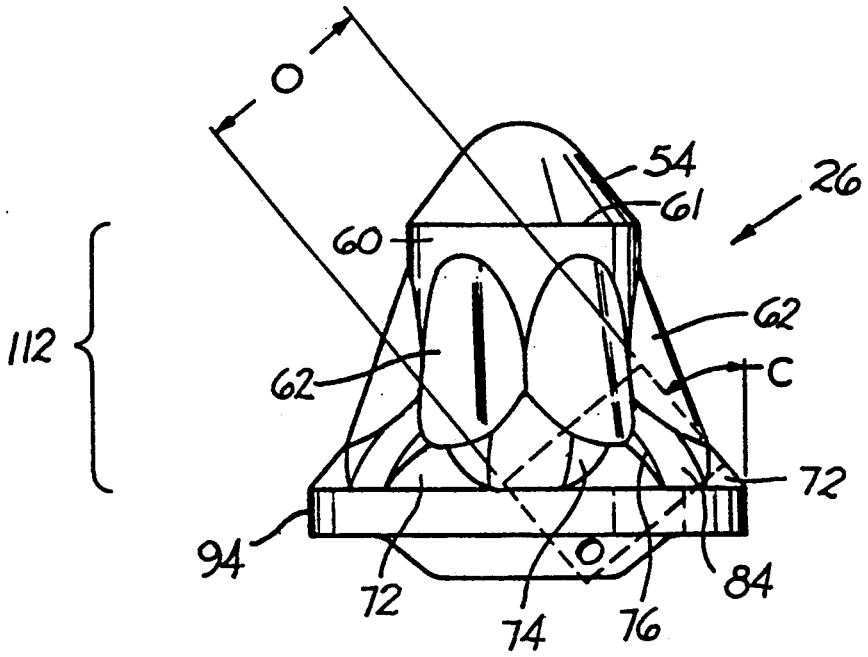
FIG. 7 is a view of the hard tip of FIG. 2 showing the orientation of the lateral cylindrical sections in the transition zone of the hard tip.

Referring to FIG. 7, each one of the lateral cylindrical sections 74 and 76 are disposed from the central longitudinal axis of the hard tip 26 at an angle "c" of about 40°. Referring still to FIG. 7, the cylindrical shape shown by the broken lines presents the shape of the lateral cylindrical sections (74, 76) wherein the diameter is the dimension "o" which for this specific embodiment is equal to about 0.351 inches.

Referring back to FIGS. 2 and 3, the mediate concave frusto-conical section 84, mentioned earlier in the present specification, separates each circumferentially sequential transition zone 70. In the specific embodiment, there are six mediate concave frusto-conical sections 84 equi-spaced about the circumference of the hard tip 26. Each one of the mediate concave frusto-conical sections 84 presents five terminations; namely, two forward terminations, two lateral terminations and one rearward termination. Each forward termination defines a portion of the boundary 78 with a corresponding rib 62. The lateral terminations define the boundaries (90 and 92) with the adjacent transition zones 70.

Figure 8:
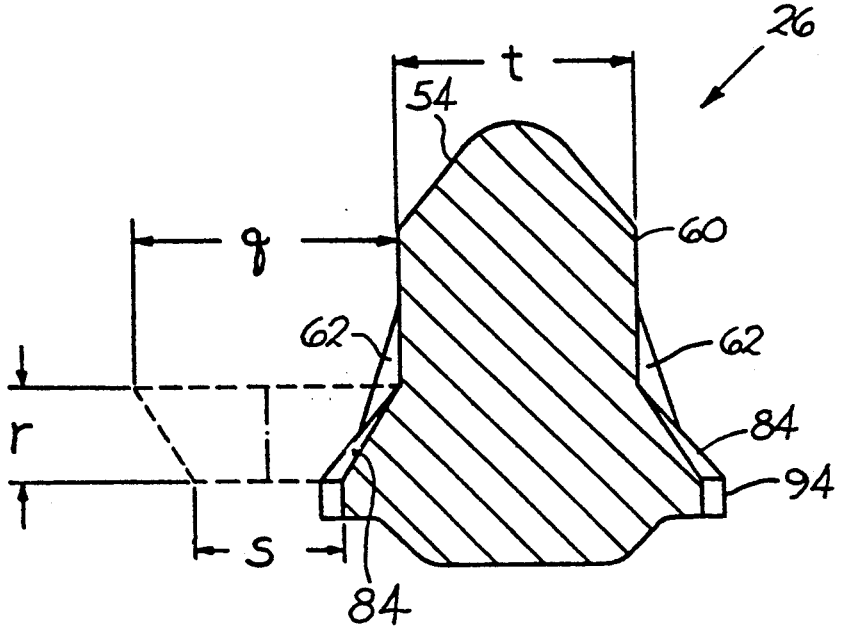
FIG. 8 is a cross-sectional view of the hard tip of FIG. 3 taken along section line 8—8.

Referring to FIG. 8, the frusto-conical volume defined by the broken lines presents the orientation of the mediate concave frusto-conical section 84. In this specific embodiment, dimension "q" is equal to about 0.483 inches, dimension "r" equals about 0.171 inches, and dimension "s" equals about 0.268 inches.

The hard cutting tip 26 further includes a structurally integral base section 94 that is axially rearward of the transition region which comprises the combination of the mediate concave frusto-conical sections 84 and the transition zones 70. The transition region is contiguous with the ribbed section and the base section 94. The transition region provides for the transition of the tip structure from the ribbed section to the base section 94.

Figure 4:
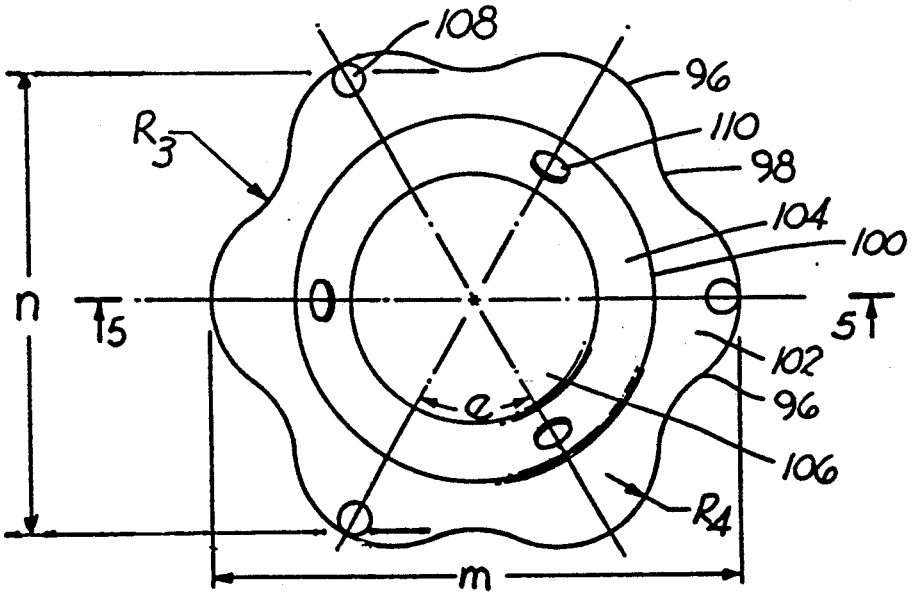
FIG. 4 is a bottom view of the hard tip of FIG. 2 hereof.

Referring specifically to FIGS. 3 and 4, the base section 94 presents a plurality of equi-spaced radially extending lobes 96 in which each lobe 96 is separated by an arcuate mediate section 98 having a radius $R_3$. In the specific embodiment, radius $R_3$ equals about 0.134 inches. Each lobe 96 has a radius $R_4$ that in the specific embodiment equals about 0.131 inches. Each lobe 96 corresponds to a rib 62 whereby the central longitudinal axis of each corresponding rib 62 and lobe 96 are in coaxial alignment as illustrated in FIG. 3. The profile of the base section 94 takes on a sinuous or wavy shape at its periphery. The relative magnitude of the radius of the lobes and the arcuate mediate sections may be different than shown in the drawings. For example, the lobes may be more pronounced in their radially outwardly extension than shown in the drawings.

Referring to FIGS. 2, 4 and 5, a seating section 100, which has a generally frusto-conical shape, is contiguous with and extends axially rearwardly of the bottom surface of the base section 94. In the specific embodiment illustrated in these drawings, the maximum dimension "l" of the seating section 100 is less than the minimum dimension "n" of the base 94. The exposed bottom surface of the base section 94 defines an axially rearward shoulder 102. Seating section 100 includes a frusto-conical portion 104 which terminates in a flat circular surface 106. It should be understood that applicants contemplate that the invention includes a structure where the maximum dimension "l" of the seating section 100 is equal, as well as less than, the minimum dimension "n" of the base 94.

Referring to FIG. 4, the shoulder 102 has a trio of equi-spaced protrusions 108 extending therefrom. The seating section 100 also has a trio of equi-spaced protrusions 110 extending therefrom. These protrusions 108, 110 facilitate the seating and brazing of the hard tip 26 to the body of the cutting tool 20. The function and purpose of these protrusions is set forth in more detail in U.S. Pat. No. 4,981,328 to Stiffler et al., owned by the assignee of the present patent application, Kennametal Inc. of Latrobe, Pa.

The dimensions of the cemented carbide tip 26 are set forth below:

| Dimension | Value (inches) |
|---|---|
| Overall axial length of the tip "f" | .772 |
| axial length of the forward section 54 "g" | .178 |
| axial length from forwardmost point where rib is contiguous with the intermediate section to the shoulder "h" | .464 |
| axial length of base section "i" | .070 |
| axial length of the seating section "j" | .079 |
| dimension of seating section at its rearward termination "k" | .350 |
| dimension of the seating section at joinder with the base section "l" | .508 |
| maximum dimension of the base section "m" | .750 |
| minimum dimension of the base section "n" | .625 |

One makes the hard tip 26 through powder metallurgical techniques. In the case where the hard tip is made of cemented carbide, loose powders of tungsten carbide, cobalt, and a pressing lubricant are placed in a die cavity. A punch-die arrangement then presses the loose powder into a selected configuration which those skilled in the art call a green compact. The green compact undergoes sintering to remove the lubricant and consolidate the tungsten carbide and cobalt to form the as-sintered part which comprises a dense tungsten carbide-cobalt alloy of a particular shape.

The portion of the hard tip 26 located between the axially forward section 54 and the base section 94 defines the primary surfaces of the die along which there is substantial movement of powder during pressing. In this application, applicant terms this portion the middle region 112, which is illustrated in FIG. 7.

As can be appreciated by viewing the geometry of the middle region 112 of the hard tip 26, there are no surfaces which are substantially perpendicular to the central longitudinal axis of the hard tip 26. The punch and die that form the shape of this middle region 112 thus do not present any surface in the axially forward part of the tip geometry that is substantially perpendicular to the longitudinal axis of the part. As a consequence, there is an absence of surfaces at which there is a significant restriction, such as those encountered with surfaces that are perpendicular to the longitudinal axis of the part, on the movement of powder in the middle region 112 during pressing. The absence of these restrictive surfaces from the middle region 112 promotes a pressed, pre-sintered part, i.e., a green compact, with an essentially uniform powder density or at least a more uniform powder density than has been achieved in the past.

Upon sintering a green compact with a more uniform density, there will be less uneven shrinkage due to density differences. The result is a reduction in cracks and voids; and hence, less potential for breakage during service. The overall vertical orientation of the surfaces of the hard tip 26 contribute to the improved overall integrity of the as-sintered tip.

In operation, the specific embodiment of the cutting tool 20 is free to rotate about its central longitudinal axis x—x (see FIG. 1) while the drum (not illustrated) rotates to drive the cutting tool 20 into an earth formation. The longitudinal axis of the drum is substantially transverse to the longitudinal axis of the rotatable cutting tool. The hard tip 26 is the component of the cutting tool 20 which first impinges upon the earth formation. Applicant now provides a description of the intended operation of a specific embodiment of the hard tip 26 as shown in FIGS. 1 through 8.

It is generally known in the art that a reduction in the dimension of the section of the hard tip that impinges upon the earth formation will necessitate less force to drive the cutting tool into the earth formation. It is also the typical case that a section of a lesser dimension will exhibit less strength, and thus, be more prone to breakage or other failure than a section with a larger dimension.

The hard tip 26 has a forward section 54 which presents a minimum dimension during initial impingement so that a lesser force is necessary to drive the cutting tool through the earth formation. As the hard tip 26 wears down, the next section to first impinge upon the earth formation, which is the intermediate section 60, presents a generally cylindrical shape so that the force necessary to drive the cutting tool does not significantly increase.

After the intermediate section 60 wears down, the ribbed section is the next section of the hard tip 26 to first impinge upon the earth formation. Although the volume of cemented carbide that impinges upon the earth formation increases as the hard tip 26 wears from the intermediate section 60 to the ribbed section, the existence of the ribs 62 presents less of a volume of cemented carbide than if the ribbed section were solid. Thus, there is a smaller increase in the force necessary to drive the cutting tool 20 through the earth formation than if the ribbed section were solid. Furthermore, the presence of the ribs 62 contributes to the overall strength of the hard tip 26 as well as to the strength of the ribbed section. In the case of the ribbed section, the strength thereof is on a level with a structure having a solid cross-section instead of the ribs by possessing most of the strength of a structure with a solid cross-section.

Referring more specifically to the wear on the ribs during use, the ribs wear in a manner that can be called preferential wear. In other words, the ribs experience a greater degree of wear at their radially outer peripheral surface than at the surfaces radially inwardly of the radially outer peripheral surface. By wearing more rapidly at the radially outer peripheral surfaces, the ribs wear toward a structure that presents a geometry with a cross-section which is more circular in form. This geometry then presents a hard tip on the partially worn tool with a smaller effective dimension than a hard tip on a partially worn tool originally having a hard tip of a solid cross-sectional shape. The smaller effective dimension results in better penetration and less blunting throughout the use of the tool.

In operation, the ribs 62 provide a very advantageous feature of the invention which applicant now describes. The ribs 62 have an orientation such that each rib 62 extends radially outwardly from the central longitudinal axis of the hard tip 26. The distance of this radial extension increases as the rib 62 moves axially rearwardly. Therefore, the rib 62 presents a geometry which flares radially outwardly from the axially forward portion to the axially rearward portion of the hard tip 26. This is also true for the ribbed section, which comprises all of the ribs 62 of the hard tip 26.

In operation, the earth formation is broken into abrasive cuttings through the impingement of the hard tip 26 upon the earth formation. The abrasive cuttings come into contact with the ribs 62 of the ribbed section. These abrasive cuttings move along the surface of the ribs 62 in an axially rearward direction as well as in a radially outward direction. It can thus be seen that the ribs 62 divert or direct the abrasive cuttings in a direction that is axially rearward and radially outward of the hard tip 26. By diverting the abrasive cuttings axially rearward and radially outward of the hard tip 26, the ribs 62 help protect the joint between the tool body and hard tip 26 from erosion due to the abrasive cuttings, i.e., "steel wash". The feature of diverting abrasive cuttings away from the joint is a very meaningful advantage of the present invention because erosion of the joint can lead to a premature failure of the cutting tool through loss of the hard tip 26.

The base section 94 presents lobes 96 which are axially forward of the joint between the hard tip 26 and the tool body. These lobes 96 help divert abrasive cuttings away from this joint so as to protect the joint from erosion by the abrasive cuttings, i.e., "steel wash". The base section 94 protects the steel body from erosion better than a tip having a base section of a dimension equal to the minimum dimension of the base section 94.

The forward end of the steel body adjacent the lobed base 94 can be of a generally frusto-conical shape with a generally circular cross section as shown in FIG. 1. Alternatively, the forward end of the steel body may present a lobed configuration that registers with the lobes of the lobed base 94. In such an alternative structure, the forward end of the steel body presents a plurality of lobes which have a consistent orientation with respect to the lobes of the lobed base section 92 about the circumference of the hard tip.

Figure 9:
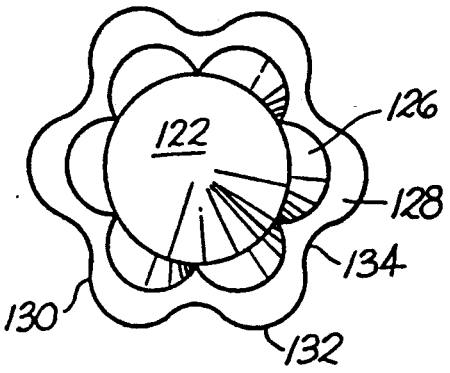
FIG. 9 is a top view of a second specific embodiment of a hard tip.
Figure 10:
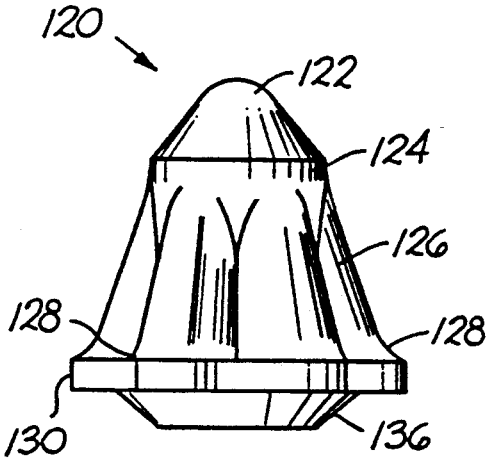
FIG. 10 is a side view of the hard tip of FIG. 9.

Referring to FIGS. 9 and 10, these drawings illustrate a second specific embodiment of the hard tip, generally designated as 120. The hard tip 120 has an axially forward section 122 and an intermediate section 124. The forward section 122 presents a shape like that of the forward section 54 of the first specific embodiment. The intermediate section 124, which is preferably of a generally cylindrical shape, is contiguous with and extends axially rearwardly from the forward section 122.

The hard tip 120 further includes a ribbed section which comprises six ribs 126 equi-spaced about the circumference of the hard tip 120. The ribbed section is contiguous with and extends axially rearwardly of the intermediate section 124. The configuration of the boundary between the intermediate section 124 and the ribbed section comprises a plurality of sequential arcuate portions.

A concave section 128 is contiguous with and extends axially rearwardly of the ribbed section so as to join the ribbed section with a lobed base section 130. The lobed base section 130 present six lobes 132 wherein each pair of sequential lobes is separated by an arcuate mediate section 134. As viewed from the top, see FIG. 9, the lobed base section 130 present a periphery with a sinuous or wavy profile. A seating section 136, which is of a generally frusto-conical shape, is contiguous with and extends axially rearwardly of the base section 130. The function of the ribs 126 and the lobed base section 130 are the same for the second specific embodiment as are the functions of the ribs 62 and lobed base section 94 for the first specific embodiment. Thus, a description of these functions will not be repeated herein.

Figure 11:
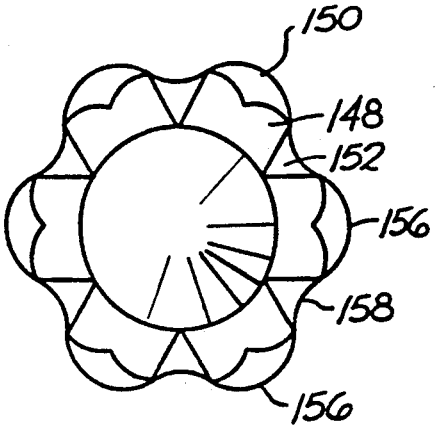
FIG. 11 is a top view of a third specific embodiment of a hard tip.
Figure 12:
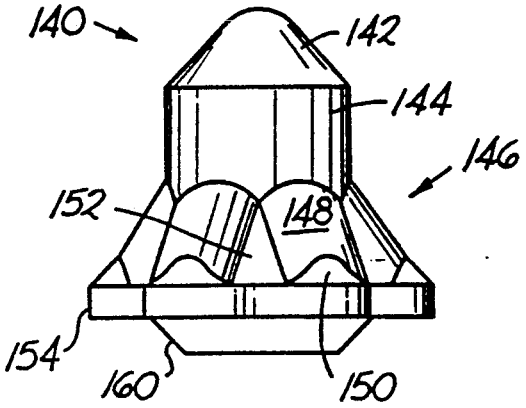
FIG. 12 is a side view of the hard tip of FIG. 11.

Referring to FIGS. 11 and 12, these drawings illustrate a third specific embodiment of the hard tip, generally designated as 140. The hard tip 140 has an axially forward section 142 and an intermediate section 144. The forward section 142 presents a shape like that of the forward section 54 of the first specific embodiment. The intermediate section 144, which is of a generally cylindrical shape, is contiguous with and extends axially rearwardly from the forward section 142.

The hard tip 140 further includes a transition region 146 which is contiguous with and extends axially rearwardly of the intermediate section 144. The transition region 146 includes six cylindrical sections 148 equi-spaced about the circumference of the hard tip 140. A concave mediate frusto-conical section 152 is between each sequential pair of cylindrical sections 148. A central frusto-conical section 150 is contiguous with and extends axially rearwardly of each cylindrical section 148.

The hard tip 140 also includes a lobed base section 154. The lobed base section 154 is contiguous with and extends axially rearwardly of the transition region 146. The lobed base section 154 present six lobes 156 wherein each pair of sequential lobes is separated by an arcuate mediate section 158. As viewed from the top, see FIG. 11, the lobed base section 154 present a periphery with a sinuous or wavy profile. A seating section 160, which is of a generally frusto-conical shape, is contiguous with and extends axially rearwardly of the lobed base section 154.

The function of the lobed base section 154 is the same for the third specific embodiment as is the function of the lobed base section 94 for the first specific embodiment. Thus, a description of this function will not be repeated herein.

Figure 13:
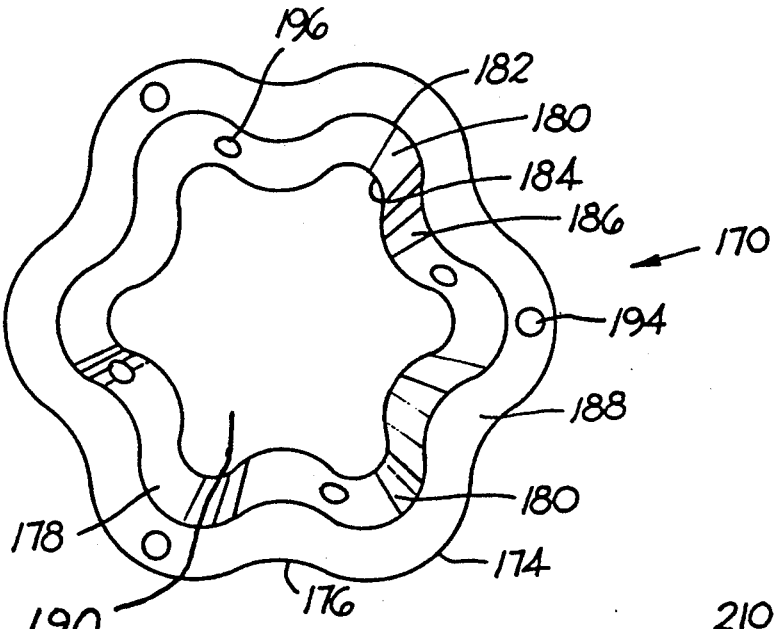
FIG. 13 is a bottom view of a fourth specific embodiment of a hard tip.
Figure 15:
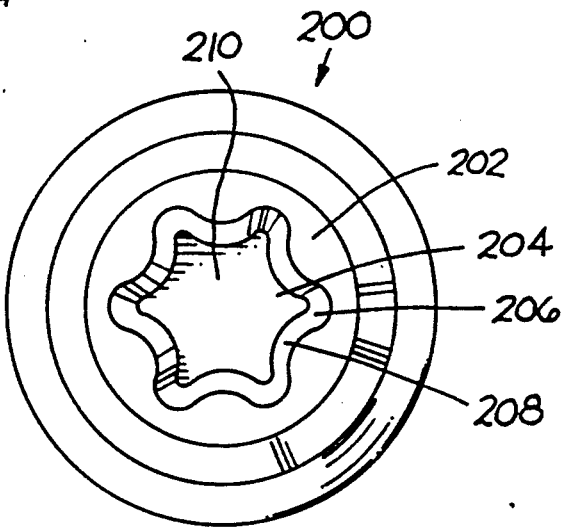
FIG. 15 is a front view of a steel tool body without the hard tip of FIG. 13 so as to illustrate the geometry of the socket that receives the hard tip.
Figure 14:
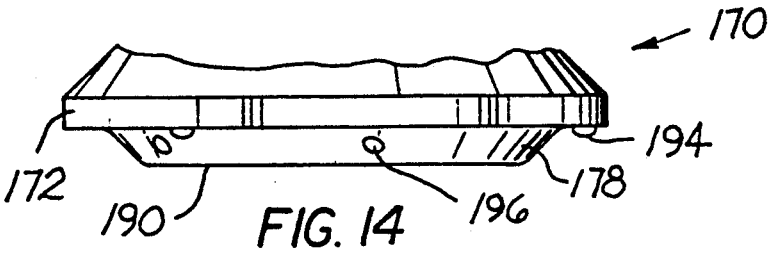
FIG. 14 is a side view of the hard tip of FIG. 13 with a portion of the hard tip removed.

Referring to FIGS. 13, 14 and 15, there is illustrated a fourth specific embodiment of a hard tip generally designated as 170. Hard tip 170 includes a lobed base section 172. The structure of the hard tip 170 that is axially forward of the lobed base section 172 is the same as that for the hard tip 26. Thus, a description of this structure of the hard tip will not be repeated herein. The lobed base section 172 presents a plurality of radially outwardly extending lobes 174 as shown in FIG. 13. Each pair of sequential lobes 174 is separated by a concave mediate section 176.

A seating section 178 extends axially rearwardly from the lobed base section 172. Seating section 178 presents one or more lobes 180 that register with the lobes 174 of the lobed base section 172. Each lobe 180 extends between its junction 182 with the base section 172 and the distal termination 184 of the lobe 180. A concave surface 186 separates each sequential lobe 180.

The maximum and minimum transverse dimensions of the section 178 at the junction 182 with the lobed base section 172 are each less than the maximum and minimum transverse dimensions of the lobed base section 172, respectively. These differences in these dimensions result in the existence of a flat axially rearwardly facing surface 188.

The seating section 178 terminates in a flat surface 190 which presents a generally sinuous configuration. The sinuous configuration of the flat surface 190 corresponds with the sinuous configuration of the juncture between the seating section 178 and the lobed base section 172 and the sinuous configuration of the lobed base section 172 as viewed from the bottom in FIG. 13.

A trio of generally equi-spaced protrusions 194 project axially rearwardly from the flat surface 188. A quartet of generally equi-spaced protrusions 196 project from the frusto-conical surface of the seating section 178. These protrusions (194 and 196) serve to position the hard tip 170 in the socket in the steel tool body and to facilitate the formation of a braze joint of a uniform thickness. In this regard, the function and purpose of these protrusions is set forth in more detail in U.S. Pat. No. 4,940,288 to Stiffler et al. previously mentioned herein.

Referring to FIG. 15, the steel tool body 200 is of a shape generally like that shown in FIG. 1, wherein the forward portion of the tool body gradually and continuously increases in dimension from the forward end 202 to the cylindrical portion that defines the axially forward part of the puller groove. The forward end 202 of the tool body 200 is substantially flat and contains a socket 204. Socket 204 presents one or more lobes 206 wherein each lobe 206 is separated by a convex section 208. The socket 204 terminates in a flat surface 210.

The lobes 206 are defined along a frusto-conical surface of the socket 204. When the hard tip 170 is positioned within the socket 204, the lobes 180 of the seating section 178 register with the lobes 206 of the socket 204. The concave surface 186 of the seating section 178 registers with the concave section 208 of the socket 204. Thus, it can be appreciated that the registration of the lobes and the concave portions of the hard tip and socket provide a positive mechanical means by which the hard tip resists rotational forces exerted thereon during operation. In other words, the lobed structure of the seating section taken together with the lobed shape of the socket helps positively retain the hard tip against rotation relative to the socket.

Thus, it can be seen that applicant has provided an improved geometry for a hard tip, as well as a cutting tool which uses such a hard tip. The hard tip presents a geometry that facilitates the even and uniform movement of powder during the powder pressing operation, which leads to a pressed, pre-sintered part having a uniform powder density. Upon sintering, a part of a uniform density experiences more uniform shrinkage during sintering, and hence, less cracks and voids. The overall result is a powder metallurgical part possessing greater integrity.

It can also be seen that applicant has provided a hard tip with a geometry that satisfies application requirements for a cutting tool for use in the excavation of earth formations such as, for example, construction tools. When a cutting tool uses the hard tip as shown and described herein, the cutting tool will easily cut the substrate with a relatively minimum expenditure of energy. Furthermore, the cutting tool will have the necessary strength to endure through a cutting application. In addition, the cutting tool will function to protect the steel body of the cutting tool from erosion, i.e., steel wash.

All patents and documents referred to herein are hereby incorporated by reference.

As is well known to those of ordinary skill in the art, that at the junctures of the various surfaces described on the carbide tip, chamfers, fillets and/or pressing flats may be provided, where appropriate, to assist in manufacturing and/or provide added strength to the structure.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. A hard tip for attachment at a joint to a tool body of an excavation tool for impinging an earth formation, the hard tip comprising:

an integral lobed section presenting a plurality of radially extending lobes having a peripheral edge axially forward of the joint for protecting said tool body from wear caused by said tip impinging said earth formation.

2. The hard tip according to claim 1 wherein said peripheral edge of said lobed section presents a sinuous shape.

3. The hard tip according to claim 1 further including an integral seating section axially rearward of said lobed section.

4. The hard tip of claim 3 wherein the seating section presents a plurality of radially extending seating lobes having a peripheral edge.

5. The hard tip of claim 4 wherein the peripheral edge of the seating section presents a sinuous shape.

6. A hard tip for attachment to a tool body of an excavation tool for impinging an earth formation, wherein the tool has a socket contained therein, the hard tip comprising, an integral seating section being received within the socket said integral seating section presenting a radially extending lobe that registers with a corresponding lobe in the socket.

7. The hard tip of claim 6 including a plurality of the radially extending lobes wherein each one of the lobes registers with its corresponding lobe in the socket.

8. The hard tip of claim 7 wherein the plurality of radially extending lobes has a peripheral edge which presents a sinuous shape.

9. The hard tip of claim 6 including at least a pair of the radially extending lobes wherein the lobes are diametrically opposed to each other, and each of the lobes registers with its corresponding lobe in the socket.

10. A cutting tool for excavating an earth formation whereby such excavation creates abrasive cuttings, the cutting tool comprising:

an elongate tool body having opposite forward and rearward ends;

a hard tip being affixed on the forward end of said tool body, said hard tip comprising:

an integral forward region;

an integral ribbed section presenting a plurality of longitudinal ribs about the circumference thereof, said ribbed section being axially rearwardly of said forward region, each one of said ribs presenting a leading edge that moves radially outwardly as the rib moves axially rearwardly so that during excavation said rib diverts abrasive cuttings in a radially outward direction;

an integral lobed base section presenting a plurality of radially extending lobes;

an integral transition region being contiguous with said ribbed section and being contiguous with said base section so as to provide a transition from said ribbed section to said base section; and an integral seating section, said seating section being contiguous with and extending axially rearwardly of said base section.

11. The cutting tool according to claim 10 wherein said forward region includes an axially forward section and an integral intermediate section, said intermediate section being contiguous with and extending between said axially forward section and said ribbed section.

12. The cutting tool according to claim 10 wherein there is a joint at the juncture where the hard tip is affixed to the forward end of the tool body, each one of said lobes being axially forward of the joint so that during excavation said lobed base section protects the joint from erosion due to the abrasive cuttings.

13. A hard tip for use in an excavation tool wherein the hard tip is generally symmetrical about its central longitudinal axis, the hard tip comprising:

an integral forward section;

an integral intermediate section, said intermediate section being contiguous with and extending axially rearwardly of said forward section;

an integral ribbed section presenting a plurality of longitudinal ribs about the circumference thereof, said ribbed section being contiguous with and extending axially rearwardly of said intermediate section;

an integral lobed base section presenting a plurality of radially extending lobes;

an integral transition region being contiguous with said ribbed section and being contiguous with said base section so as to provide a transition from said ribbed section to said base section; and an integral seating section, said seating section being contiguous with and extending axially rearwardly of said base section.

14. The cemented carbide tip according to claim 13 wherein each of said ribs protruding radially outwardly with respect to the central longitudinal axis of the tip, each one of said ribs presenting a generally arcuate surface along the entire length of said rib wherein the distance each one of said ribs protrudes radially outwardly increases as the tip moves axially rearwardly so that during excavation said rib diverts abrasive cuttings in a radially outward direction.

15. The hard tip according to claim 13 wherein each one of said ribs corresponds to each one of said lobes of said base section so that each of the corresponding pairs of said ribs and said lobes are in general axial alignment.

16. The hard tip according to claim 13 wherein said transition region includes a transition zone corresponding to each one of said ribs, and each one of said transition zones providing a transition from its corresponding one of said ribs to said base section.

17. An excavation tool for excavating an earth formation thereby creating abrasive cuttings, the excavation tool comprising:

an elongate tool body having opposite forward and rearward ends;

a hard tip for engaging earth formations being affixed to said tool body at said forward end thereof;

said hard tip comprising:

an integral forward section;

an integral intermediate section, said intermediate section being contiguous with and extending axially rearwardly of said forward section;

an integral ribbed section presenting at least one longitudinal rib, said ribbed section being contiguous with and extending axially rearwardly of said intermediate section;

an integral lobed base section presenting a plurality of radially extending lobes;

an integral transition region being contiguous with said ribbed section and being contiguous with said base section so as to provide a transition from said ribbed section to said base section; and an integral seating section, said seating section being contiguous with and extending axially rearwardly of said base section.

18. The excavation tool of claim 17 wherein the tool body includes a socket in the forward end thereof, and the integral seating section is received within the socket.

19. The excavation tool of claim 18 wherein the integral seating section presents a radially extending seating lobe that registers with a corresponding lobe in the socket.

20. The excavation tool of claim 19 wherein the integral seating section presents a plurality of the radially extending seating lobes wherein each one of the seating lobes registers with its corresponding one of the lobes in the socket.

* * * * *